United States Patent [19]

Murata et al.

[11] Patent Number: 4,829,049

[45] Date of Patent: May 9, 1989

[54] TRANSFER SHEET FOR HEAT SENSITIVE TRANSFER RECORDING

[75] Inventors: Yukichi Murata, Sagamihara; Shuichi Maeda, Saitama, both of Japan

[73] Assignee: Mitsubishi Chemical Industries Limited, Tokyo, Japan

[21] Appl. No.: 7,647

[22] Filed: Jan. 28, 1987

[51] Int. Cl.[4] ..... B41M 5/035; B41M 5/26

[52] U.S. Cl. ..... 503/227; 8/471; 428/195; 428/913; 428/914

[58] Field of Search ..... 8/470, 471; 428/195, 428/913, 914, 211, 473.5, 474.4, 480; 430/201, 945

[56] References Cited

U.S. PATENT DOCUMENTS

| | | | |
|---|---|---|---|
| 4,259,236 | 3/1981 | Koller et al. | 534/777 |
| 4,614,521 | 9/1986 | Niwa et al. | 430/964 |

FOREIGN PATENT DOCUMENTS

| | | | |
|---|---|---|---|
| 0118963 | 9/1980 | Japan | 534/795 |
| 58-38754 | 7/1983 | Japan | 8/662 |
| 0030394 | 2/1985 | Japan | 503/227 |
| 1465895 | 2/1977 | United Kingdom | 503/227 |

*Primary Examiner*—Bruce H. Hess

*Attorney, Agent, or Firm*—Jordan B. Bierman;

[57] ABSTRACT

A transfer sheet for heat sensitive transfer recording is disclosed, comprising a base film having provided thereon a coloring layer containing a dye represented by formula

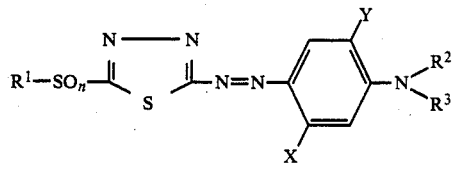

wherein $R^1$ represents a substituted or unsubstituted alkyl group, a substituted or unsubstituted aralkyl group, or an allyl group; $R^2$ and $R^3$ each represents a hydrogen atom, a substituted or unsubstituted alkyl group, a substituted or unsubstituted aralkyl group, or an allyl group; X and Y each represents a hydrogen atom, an alkoxy group, an alkyl group, or a halogen atom; and n represents 1 or 2. The transfer sheet provides a transferred image excellent in uniformity, color density, color reproduction, and preservability.

14 Claims, No Drawings

TRANSFER SHEET FOR HEAT SENSITIVE TRANSFER RECORDING

FIELD OF THE INVENTION

This invention relates to a transfer sheet for sublimation type heat sensitive transfer recording.

BACKGROUND OF THE INVENTION

Techniques for recording color images of facsimiles, copying machines, television images, etc. have hitherto been demanded, and studies on color recording techniques have been directed to electrophotography, ink-jet recording, heat sensitive transfer, and the like.

A heat sensitive transfer recording system is considered advantageous as compared with other techniques because of easiness in maintenance or operation of devices and low cost of devices and supplies.

The heat sensitive transfer recording system includes a melt system in which a transfer sheet comprising a base film having formed thereon a hot melt ink layer is heated by a heating means, e.g., a heat-sensitive head, an infrared ray, etc., to melt and transfer the ink to a recording material and a sublimation system in which a transfer sheet comprising a base film having formed thereon an ink layer containing a subliming dye is heated by a heating means to sublimate and transfer the dye to a recording material. The latter system is particularly advantageous for full color recording since the amount of the dye to be sublimated and trnasferred can be controlled by varying a heating energy applied thereby making it easy to achieve recording with gradation.

In the sublimation type heat sensitive transfer recording system, the subliming dyes to be used in the transfer sheet are very important as giving great influences on transfer recording speed, image quality of records, preservability of records, and the like, and should meet the following requirements:

(a) To easily sublime under operating conditions of a commonly employed heating means, such as a heat sensitive recording head.
(b) Not to be heat-decomposed under the operation conditions before sublimation.
(c) To have a hue favorable in view of color reproduction.
(d) To have a high molecular extinction coefficient.
(e) To be stable against heat, light, moisture, chemicals, etc.
(f) To be synthesized easily.
(g) To have excellent applicability as inks.

SUMMARY OF THE INVENTION

One object of this invention is to provide a transfer sheet for sublimation type heat sensitive recording, in which a color former layer contains a magenta dye satisfying all the above-described requirements.

This invention relates to a transfer sheet for heat sensitive transfer recording, which comprises a base film having provided thereon a coloring layer containing a dye represented by formula (I) hereinafter described.

Formula (I) is represented by

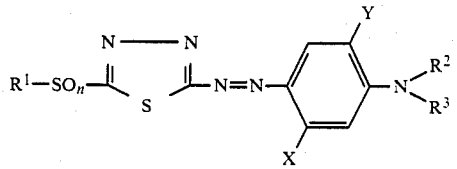

(I)

wherein $R^1$ represents a substituted or unsubstituted alkyl group, a substituted or unsubstituted aralkyl group, or an allyl group; $R^2$ and $R^3$ (which may be the same or different) each represents a hydrogen atom, a substituted or unsubstituted alkyl group, a substituted or unsubstituted aralkyl group, or an allyl group; X and Y each represents a hydrogen atom, an alkoxy group, an alkyl group, or a halogen atom; and n represents 1 or 2.

DETAILED DESCRIPTION OF THE INVENTION

In formula (I), the substituted or unsubstituted alkyl group as represented by $R^1$, $R^2$, or $R^3$ includes a straight chain or branched chain alkyl group having from 1 to 8 carbon atoms, and preferably an alkyl group having from 1 to 4 carbon atoms, e.g., a methyl, ethyl, propyl, butyl groups, etc. The substituted or unsubstituted aralkyl group as represented by $R^1$, $R^2$, or $R^3$ includes an aralkyl group having from 7 to 8 carbon atoms, e.g., benzyl and phenethyl groups. Substituent acceptable for these alkyl or aralkyl groups include a halogen atom (e.g., a chlorine atom , a bromine atom, etc.), a cyano group, a hydroxyl group, an alkoxy group having from 1 to 4 carbon atoms (e.g., a methoxy group, an ethoxy group, etc.), etc.

The alkoxy group and alkyl group as represented by X or Y include an alkoxy group having from 1 to 4 carbon atoms, and an alkyl group having from 1 to 4 carbon atoms, respectively. A preferred alkyl group is a methyl group. The halogen atom as represented by X or Y includes a chlorine atom, a bromine atom, a fluorine atom, etc.

Of the compounds represented by formula (I), particularly preferred are those wherein $R^1$ is an alkyl group having from 1 to 4 carbon atoms or an aralkyl group having 7 or 8 carbon atoms; $R^2$ and $R^3$ each is an alkyl group having from 1 to 4 carbon atoms, an alkoxyalkyl group having from 2 to 6 carbon atoms, e.g., an alkyl group having 1 or 2 carbon atoms substituted with an alkoxy group having from 1 to 4 carbon atoms, a $\beta$-chloroethyl group, a $\beta$-cyanoethyl group, or a $\beta$-hydroxyethyl group; X is a hydrogen atom, a methyl group, a chlorine atom, or a fluorine atom, and more preferably a hydrogen atom or a methyl group; Y is a hydrogen atom or a methyl group, and more preferably a hydrogen atom; and n is 2.

When $R^1$, $R^2$, or $R^3$ represents an aralkyl group substituted with a chlorine atom, the chlorine atom is preferably bonded to the aryl moiety thereof.

The dyes of formula (I) according to the present invention can be prepared by, for example, diazotizing a 2-amino-1,3,4-thiadiazole represented by formula (II)

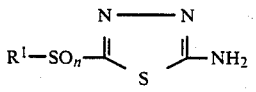

(II)

wherein $R^1$ and n are as defined above, in a usual manner, and coupling the resulting diazo compound with an aniline represented by formula (III)

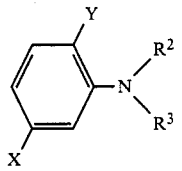

(III)

wherein X, Y, $R^2$, and $R^3$ are as defined above.

The dyes of formula (I) of the invention can also be synthesized by treating an azo dye represented by formula (IV)

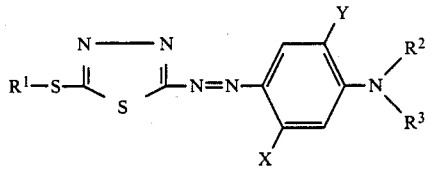

(IV)

wherein $R^1$, $R^2$, $R^3$, X, and Y are as defined above, with an oxidizing agent, such as hydrogen peroxide, in concentrated sulfuric acid.

Specific examples, though nonlimitative, of the dyes according to the present invention are shown in working examples hereinafter given.

Incorporation of the above-described dye of the invention in a heat sensitive transfer sheet can be carried out by dissolving or finely dispersing the dye of formula (I) in a medium together with a binder to prepare an ink and coating the ink on a base film, followed by drying to form a color former layer.

Binders to be used include water-soluble resins, such as cellulose type, acrylic acid type, starch type, etc.; and organic solvent- or water-soluble resins, such as acrylic resins, methacrylic acid resins, polystyrene, polycarbonate, polysulfone, polyethersulfone, polyvinyl butyral, ethyl cellulose, acetyl cellulose, etc.

Media which can be used in the ink preparation include water and organic solvents, such as alcohols, e.g., methanol, isopropanol, isobutanol, etc.; cellosolves, e.g., methyl cellosolve, ethyl cellosolve, etc.; aromatic solvents, e.g., toluene, xylene, chlorobenzene, etc.; esters, e.g., ethyl acetate, butyl acetate, etc.; ketones, e.g., acetone, methyl ethyl ketone, methyl isobutyl ketone, cyclohexanone, etc.; chlorinated hydrocarbons, e.g., methylene chloride, chloroform, trichloroethylene, etc.; ethers, e.g., tetrahydrofuran, dioxane, etc.; N,N-dimethylformamide, N-methylpyrrolidone, and so on.

If desired, the ink may further contain other additives, such as organic or inorganic non-subliming fine particles, dispersing agents, antistatics, anti-blocking agents, defoaming agents, antioxidants, viscosity controlling agents, and the like.

The base film which can be used as a support of the transfer sheet according to the invention are required to be dense and thin for enhancing thermal conductivity; to have satisfactory heat resistance; to have satisfactory smoothness for uniformly coating a color former layer and for obtaining intimate contact with a thermal head; and to be free from strike-through of an ink; and the like. Base films satisfying these requirements include tissue paper, such as condenser paper, glassine paper, etc., and heat resistant plastic films, such as polyester, polyamide, polyimide, etc. The thickness of the film to be used ranges from 3 to 50 μm. Of these, a polyethylene terephthalate film and a polyimide film are preferred, with a polyethylene terephthalate film being more preferred.

The heat sensitive transfer sheet in accordance with the present invention essentially comprises the aforesaid base film on which a color former layer containing the dye of formula (I) is formed. If desired, a heat resisting lubricating layer may be provided on the back side of the transfer sheet in order to improve running properties of the sheet in contact with a thermal head or heat resistance of the sheet. Such a lubricating layer can be formed usually by coating a composition containing a fine particle of an inert inorganic compound, e.g., silica, additives, such as a lubricant, a surface active agent, etc., and a resin binder, e.g., an epoxy resin, an acrylic resin, a urethane resin, a polycarbonate resin, etc.

Coating of an ink on the base film can be carried out in accordance with a known method, as described in Yuji Harazaki, *Coating Hoshiki,* Maki Shoten (1979), by using a reverse roll coater, a gravure coater, a rod coater, an air doctor coater, and the like. The ink is usually coated to a dry thickness of from 0.1 to 5 μm.

Since the azo dyes of formula (I) according to the present invention have a distinct magenta color, they are suitably combined with appropriate yellow and cyan colors to achieve full color recording with satisfactory color reproducibility. Moreover, because of their susceptibility to sublimation and great molecular extinction coefficients, they can afford recording at a high rate with high color densities without imposing a heavy burden on a heating means, e.g., a thermal head. Further, their stability against heat, light, moisture, chemicals, etc. protects them from thermal decomposition during transfer recording and provides color images excellent in preservability. Furthermore, since the dyes of formula (I) exhibit satisfactory organic solvent-solubility and water-dispersibility, it is easy to prepare an ink solution or dispersion in a high concentration, and use of such an ink provide a transfer sheet in which the dye is coated uniformly at a high concentration. Thus, the transfer sheet according to the present invention makes it possible to accomplish recording excellent in uniformity and color density.

The invention will now be illustrated in greater detail with reference to the following examples, but it should be understood that the present invention is not limited thereto.

EXAMPLE 1

(a) Preparation of Ink

| | |
|---|---|
| Dye of formula | 10 g |

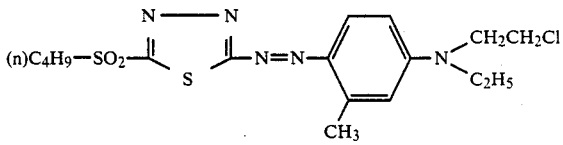

| | |
|---|---|
| Cellulose acetate (L-30, produced by Daisel Ltd.) | 10 g |
| Methyl ethyl ketone | 80 g |
| Total: | 100 g |

A mixture comprising the above components was treated in a paint conditioner for 10 minutes to prepare an ink. The dye and the resin were completely dissolved to obtain a uniform ink solution.

(b) Preparation of Transfer Sheet

The above-prepared ink was coated on a 15 μm thick polyimide film by the use of a bar coater (No.1 Model, manufactured by RK Print Coat Instruments Co.) and dried to obtain a transfer sheet.

(c) Transfer Recording

The ink coated surface of the transfer sheet was brought into contact with a recording material, and recording was effected under the following conditions:

| | |
|---|---|
| Linear density of main and side scan: | 4 dot/mm |
| Recording power: | 0.6 W/dot |
| Heating time of Head: | 10 m. sec |

The recording material used here was prepared by coating 110 μm thick synthetic paper with a composition comprising 10 g of a 34 wt % aqueous dispersion of a saturated polyester (Vylonal MD-1200, produced by Toyo Spinning Co., Ltd.) and 1 g of silica (Nipsil E220A, produced by Nippon Silica Kogyo K.K.) by means of a bar coater (No. 3 Model, produced by RK Print Coat Instruments Co.), followed by drying.

The resulting recorded image showed a distinct magenta color with a uniform color density of 1.30 as measured by a Macbeth densitometer (RD-514 Model; filter Wratten filter No. 58).

Light-fastness of the recorded image was determined by fading test using a carbon arc fadeometer (manufactured by Suga Shikenki K.K.; black panel temperature: 63°±2° C.; exposure time: 40 hours). As a result, the image underwent substantially no discoloration or fading. Further, the transfer sheet and the recorded image exhibited stability against heat and moisture and excellent preservability in dark.

The dye used in this example was synthesized by oxidizing a dye of formula

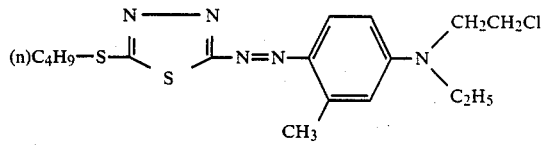

with hydrogen peroxide in concentrated sulfuric acid. This dye had its maximum absorption in chloroform at a wavelength ($\lambda_{max}$) of 528 nm.

EXAMPLE 2

The same procedures of Example 1 were repeated except for using each of dyes shown in Table 1 in place of the dye used in Example 1. As a result, a distinct magenta image having a color density as shown in Table 1 was obtained.

TABLE 1

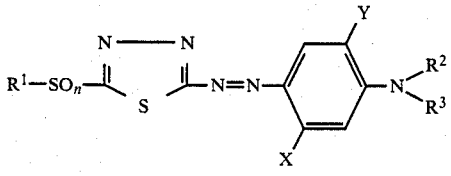

(I)

| Run No. | Dye Structure $R^1$ | $R^2$ | $R^3$ | X | Y | n | Color Density | $\lambda_{max}$ (nm)* |
|---|---|---|---|---|---|---|---|---|
| 2-1 | $-CH_3$ | $-CH_2CH_2Cl$ | $-C_4H_9(n)$ | $-CH_3$ | $-H$ | 2 | 1.28 | 529 |
| 2-2 | $-C_2H_5$ | $-CH_2CH_2Cl$ | $-C_2H_5$ | $-CH_3$ | $-H$ | 2 | 1.30 | 528 |
| 2-3 | $-CH_2CH(C_2H_5)C_4H_9(n)$ | $-CH_2CH_2Cl$ | $-C_2H_5$ | $-CH_3$ | $-H$ | 2 | 1.20 | 528 |
| 2-4 | $-C_4H_9(iso)$ | $-CH_2CH_2Cl$ | $-C_2H_5$ | $-CH_3$ | $-H$ | 2 | 1.30 | 528 |
| 2-5 | $-C_4H_9(n)$ | $-CH_2CH_2Cl$ | $-CH-CH=CH_2$ | $-CH_3$ | $-H$ | 2 | 1.28 | 524 |
| 2-6 | $-C_4H_9(n)$ | $-C_2H_5$ | 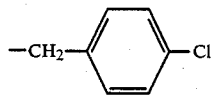 | $-CH_3$ | $-H$ | 2 | 1.15 | 528 |
| 2-7 | $-C_4H_9(n)$ | $-CH_2CH_2Cl$ | 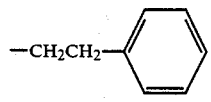 | $-CH_3$ | $-H$ | 2 | 1.18 | 526 |
| 2-8 | $-C_4H_9(n)$ | $-CH_2CH_2Cl$ | $-CH_2CH_2-OC_4H_9(n)$ | $-CH_3$ | $-H$ | 2 | 1.25 | 526 |
| 2-9 | $-C_2H_5$ | $-CH_2CH_2Cl$ | $-CH_2CH(C_2H_5)C_4H_9(n)$ | $-CH_3$ | $-H$ | 2 | 1.23 | 530 |
| 2-10 | $-C_2H_5$ | $-C_2H_4CN$ | $-C_4H_9(n)$ | $-CH_3$ | $-H$ | 2 | 1.28 | 522 |
| 2-11 | $-C_4H_9(n)$ | $-C_2H_4CN$ | $-C_4H_9(n)$ | $-CH_3$ | $-H$ | 2 | 1.25 | 522 |
| 2-12 | $-C_4H_9(n)$ | $-C_2H_5$ | $-C_2H_5$ | $-Cl$ | $-H$ | 2 | 1.28 | 541 |
| 2-13 | $-C_4H_9(n)$ | $-C_2H_5$ | $-C_2H_5$ | $-Br$ | $-H$ | 2 | 1.18 | 540 |
| 2-14 | $-C_4H_9(n)$ | $-C_4H_9(n)$ | $-C_4H_9(n)$ | $-F$ | $-H$ | 2 | 1.35 | 538 |
| 2-15 | $-C_4H_9(n)$ | $-CH_2CH_2Cl$ | $-CH_2CH_2Cl$ | $-OCH_3$ | $-H$ | 2 | 1.15 | 530 |
| 2-16 | $-C_4H_9(n)$ | $-CH_2CH_2Cl$ | $-CH_2CH_2Cl$ | $-OC_4H_9(n)$ | $-H$ | 2 | 1.15 | 530 |
| 2-17 | $-C_4H_9(n)$ | $-CH_2CH_2Cl$ | $-CH_2CH_2OH$ | $-CH_3$ | $-H$ | 2 | 1.20 | 525 |

TABLE 1-continued

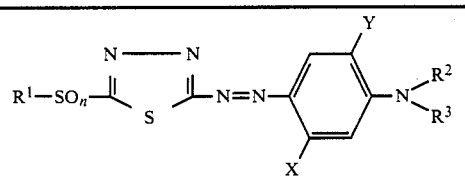

(I)

| Run No. | Dye Structure $R^1$ | $R^2$ | $R^3$ | X | Y | n | Color Density | $\lambda_{max}$ (nm)* |
|---|---|---|---|---|---|---|---|---|
| 2-18 | $-CH_2-$ 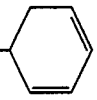 | $-CH_2CH_2Cl$ | $-C_2H_5$ | $-CH_3$ | $-H$ | 2 | 1.20 | 529 |
| 2-19 | $-CH_2CH_2-$ 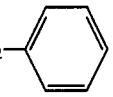 | $-CH_2CH_2Cl$ | $-C_2H_5$ | $-CH_3$ | $-H$ | 2 | 1.18 | 528 |
| 2-20 | $-CH_2-$ 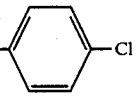 $-Cl$ | $-CH_2CH_2Cl$ | $-C_2H_5$ | $-CH_3$ | $-H$ | 2 | 1.10 | 530 |
| 2-21 | $-CH_2-CH=CH_2$ | $-CH_2CH_2Cl$ | $-C_2H_5$ | $-CH_3$ | $-H$ | 2 | 1.30 | 529 |
| 2-22 | $-C_4H_9(n)$ | $-C_2H_5$ | $-C_4H_9(n)$ | $-H$ | $-H$ | 2 | 1.28 | 535 |
| 2-23 | $-C_4H_9(n)$ | $-C_2H_5$ | $-CH_2CH_2OC_2H_5$ | $-H$ | $-H$ | 2 | 1.25 | 532 |
| 2-24 | $-C_4H_9(n)$ | $-C_2H_5$ | $-CH_2CH_2OC_4H_9(n)$ | $-H$ | $-H$ | 2 | 1.25 | 532 |
| 2-25 | $-C_4H_9(n)$ | $-CH_2CH_2Cl$ | $-C_4H_9(n)$ | $-H$ | $-H$ | 2 | 1.20 | 520 |
| 2-26 | $-C_4H_9(n)$ | $-CH_2CH_2Cl$ | $-CH_2CH_2OC_4H_9(n)$ | $-H$ | $-H$ | 2 | 1.20 | 518 |
| 2-27 | $-C_2H_5$ | $-CH_2CH_2Cl$ | $-CH_2CH_2OC_2H_5$ | $-H$ | $-H$ | 2 | 1.22 | 518 |
| 2-28 | $-C_2H_5$ | $-H$ | $-C_4H_9(n)$ | $-H$ | $-CH_3$ | 2 | 1.28 | 530 |
| 2-29 | $-C_4H_9(n)$ | $-H$ | $-C_2H_5$ | $-H$ | $-CH_3$ | 2 | 1.28 | 530 |
| 2-30 | $-C_4H_9(n)$ | $-H$ | $-C_4H_9(n)$ | $-H$ | $-Cl$ | 2 | 1.15 | 515 |
| 2-31 | $-C_4H_9(n)$ | $-H$ | $-C_2H_5$ | $-H$ | $-Br$ | 2 | 1.10 | 515 |
| 2-32 | $-C_4H_9(n)$ | $-H$ | $-C_4H_9(n)$ | $-H$ | $-F$ | 2 | 1.25 | 515 |
| 2-33 | $-C_4H_9(n)$ | $-H$ | $-CH_2CH_2Cl$ | $-H$ | $-OCH_3$ | 2 | 1.23 | 522 |
| 2-34 | $-C_4H_9(n)$ | $-H$ | $-CH_2CH_2Cl$ | $-H$ | $-OC_4H_9(n)$ | 2 | 1.21 | 522 |
| 2-35 | $-C_4H_9(n)$ | $-C_4H_9(n)$ | $-C_4H_9(n)$ | $-H$ | $-H$ | 1 | 1.25 | 530 |
| 2-36 | $-C_4H_9(n)$ | $-C_2H_5$ | $-C_2H_5$ | $-H$ | $-H$ | 1 | 1.25 | 529 |
| 2-37 | $-C_2H_5$ | $-C_4H_9(n)$ | $-C_4H_9(n)$ | $-H$ | $-H$ | 1 | 1.25 | 530 |
| 2-38 | $-C_2H_5$ | $-C_4H_9(n)$ | $-C_4H_9(n)$ | $-CH_3$ | $-H$ | 1 | 1.28 | 533 |
| 2-39 | $-C_2H_5$ | $-CH_2CH_2Cl$ | $-C_4H_9(n)$ | $-CH_3$ | $-H$ | 1 | 1.25 | 522 |
| 2-40 | $-C_2H_5$ | $-CH_2CH_2-$ 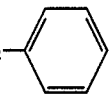 | $-C_4H_9(n)$ | $-CH_3$ | $-H$ | 1 | 1.18 | 530 |
| 2-41 | $-C_4H_9(n)$ | $-CH_2-$  | $-C_2H_5$ | $-CH_3$ | $-H$ | 1 | 1.18 | 524 |
| 2-42 | $-C_4H_9(n)$ | $-CH_2CH_2OC_2H_5$ | $-C_4H_9(n)$ | $-CH_3$ | $-H$ | 1 | 1.20 | 530 |
| 2-43 | $-C_4H_9(n)$ | $-CH_2CH_2OC_4H_9(n)$ | $-C_4H_9(n)$ | $-CH_3$ | $-H$ | 1 | 1.20 | 530 |
| 2-44 | $-CH_2CH_2OC_2H_5$ | $-C_4H_9(n)$ | $-C_4H_9(n)$ | $-CH_3$ | $-H$ | 1 | 1.20 | 533 |
| 2-45 | $-CH_2CH_2OC_2H_5$ | $-C_4H_9(n)$ | $-C_4H_9(n)$ | $-H$ | $-H$ | 1 | 1.18 | 530 |

Note:
*in chloroform

EXAMPLE 3

The same procedures of Example 1 were repeated except for replacing the polyimide base film as used in Example 1 with a 6 μm thick polyethylene terephthalate film having coated on the back side thereof with a composition comprising 8 parts by weight of a polycarbonate resin, 1 part by weight of a phosphoric acid ester type surface active agent, and 91 parts by weight of toluene to a dry thickness of about 0.5 μm so as to have heat resistance and lubricating properties. As a result of transfer recording, a transferred image having a distinct magenta color was obtained.

While the invention has been described in detail and with reference to specific embodiments thereof, it will be apparent to one skilled in the art that various changes and modifications can be made therein without departing from the spirit and scope thereof.

What is claimed is:

1. A transfer sheet for heat sensitive transfer recording comprising a base film having provided thereon a coloring layer containing a dye represented by formula

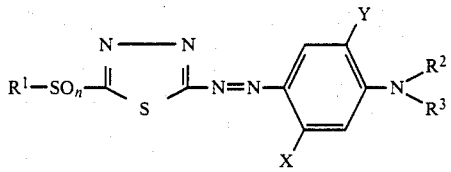

(I)

wherein $R^1$ represents a substituted or unsubstituted alkyl group, a substituted or unsubstituted aralkyl group, or an allyl group; $R^2$, and $R^3$ each represents a hydrogen atom, a substituted or unsubstituted alkyl group, a substituted or unsubstituted aralkyl group, or an allyl group; X and Y each represents a hydrogen atom, an alkoxy group, an alkyl group, or a halogen atom; and n represents 1 or 2.

2. A transfer sheet as in claim 1, wherein $R^1$ represents an alkyl group having from 1 to 8 carbon atoms, an alkyl group having from 1 to 8 carbon atoms substituted with an alkoxy group having 1 or 2 carbon atoms, an aralkyl group having from 7 to 8 carbon atoms, an alkyl group having 1 or 2 carbon atoms substituted with a chlorophenyl group, or an allyl group; $R^2$ and $R^3$ each represents a hydrogen atom, an alkyl group having from 1 to 8 carbon atoms, an alkyl group having from 1 to 8 carbon atoms substituted with a chlorine atom, a cyano group, a hydroxyl group, or an alkoxy group having from 1 to 4 carbon atoms, an aralkyl group having from 7 to 8 carbon atoms, an alkyl group having 1 or 2 carbon atoms substituted with a chorophenyl group, or an allyl group; and X and Y each represents a hydrogen atom, an alkoxy group having from 1 to 4 carbon atoms, a methyl group, a chlorine atom, a bromine atom, or a fluorine atom.

3. A transfer sheet as in claim 1, wherein $R^1$ represents an alkyl group having from 1 to 8 carbon atoms, an aralkyl group having from 7 to 8 carbon atoms, or an alkyl group having 1 or 2 carbon atoms substituted with a chlorophenyl group; $R^2$ and $R^3$ each represents an alkyl group having from 1 to 8 carbon atoms, an alkyl group having 1 or 2 carbon atoms substituted with a chlorine atom, a cyano group, a hydroxyl group, or an alkoxy group having from 1 to 4 carbon atoms, an aralkyl group having from 7 to 8 carbon atoms, or an alkyl group having 1 or 2 carbon atoms substituted with a chlorophenyl group; X represents a hydrogen atom, a methyl group, an alkoxy group having from 1 to 4 carbon atoms, a chlorine atom, a bromine atom, or a fluorine atom; and Y represents a hydrogen atom or a methyl group.

4. A transfer sheet as in claim 1, wherein $R^1$ represents an alkyl group having from 1 to 4 carbon atoms or an aralkyl group having from 7 to 8 carbon atoms; $R^2$ and $R^3$ each represents an alkyl group having from 1 to 4 carbon atoms, an aralkyl group having from 7 to 8 carbon atoms, or a $\beta$-chloroethyl group; X represents a hydrogen atom or a methyl group; Y represents a hydrogen atom; and n represents 2.

5. A transfer sheet as in claim 1, wherein $R^1$ represents an alkyl group having from 1 to 4 carbon atoms; $R^2$ represents a $\beta$-chloroethyl group; $R^3$ represents an alkyl group having from 1 to 4 carbon atoms or an aralkyl group having from 7 to 8 carbon atoms; X represents a methyl group; Y represents a hydrogen atom; and n represents 2.

6. A transfer sheet as in claim 1, wherein $R^1$ represents an aralkyl group having 7 or 8 carbon atoms; $R^2$ represents a $\beta$-chloroethyl group; $R^3$ represents an alkyl group having from 1 to 4 carbon atoms; X represents a methyl group; Y represents a hydrogen atom; and n represents 2.

7. A transfer sheet as in claim 1, wherein $R^1$ represents an alkyl group having from 1 to 4 carbon atoms; $R^2$ represents an ethyl group or a $\beta$-chloroethyl group; $R^3$ represents an alkyl group having from 1 to 4 carbon atoms; X and Y each represents a hydrogen atom; and n represents 2.

8. A transfer sheet as in claim 1, wherein the base film is tissue paper.

9. A transfer sheet as in claim 1, wherein the base film is a polyester film, a polyamide film, or a polyimide film.

10. A transfer sheet as in claim 9, wherein the base film is a polyethylene terephthalate film or a polyimide film.

11. A transfer sheet as in claim 1, wherein the base film further provided on the back side thereof a heat resisting lubricating layer.

12. A transfer sheet as in claim 1, wherein the base film has a thickness of from 3 to 50 $\mu$m.

13. A transfer sheet as in claim 1, wherein the color former layer has a thickness of from 0.1 to 5 $\mu$m.

14. A transfer sheet as in claim 1, wherein the coloring layer is obtained by dissolving or dispersing the dye of formula (I) in water or an organic solvent together with a binder to prepare an ink, and coating the ink on the base film, followed by drying.

* * * * *